US007669283B2

(12) United States Patent
Dever

(10) Patent No.: US 7,669,283 B2
(45) Date of Patent: Mar. 2, 2010

(54) METHOD AND APPARATUS FOR DEEP CLEANING RUG OR CARPET

(75) Inventor: Kerry L. Dever, Lexington, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 1226 days.

(21) Appl. No.: 11/209,544

(22) Filed: Aug. 23, 2005

(65) Prior Publication Data

US 2006/0042040 A1 Mar. 2, 2006

Related U.S. Application Data

(60) Provisional application No. 60/604,352, filed on Aug. 25, 2004.

(51) Int. Cl.
*A47L 9/04* (2006.01)

(52) U.S. Cl. ..... 15/375; 15/383

(58) Field of Classification Search ..... 15/375, 15/383; *A47L 9/04*

See application file for complete search history.

(56) References Cited

U.S. PATENT DOCUMENTS

| | | | | |
|---|---|---|---|---|
| 1,207,816 A | | 12/1916 | Thompson | |
| 1,601,774 A | | 10/1926 | Scheffer | |
| 2,008,371 A | | 7/1935 | Smellie | |
| 2,085,700 A | | 6/1937 | Kitto | |
| 2,271,552 A | | 2/1942 | Smellie | |
| 2,281,798 A | | 5/1942 | Prince | |
| 2,287,923 A | | 6/1942 | White | |
| 2,297,366 A | | 9/1942 | Pierce | |
| 3,032,800 A | * | 5/1962 | Anderson | 15/371 |
| 3,225,374 A | | 12/1965 | Daley | |
| 3,225,379 A | * | 12/1965 | Cummins | 15/367 |
| 3,855,666 A | | 12/1974 | Erikson et al. | |
| 4,430,768 A | | 2/1984 | Novinger | |
| 4,914,777 A | | 4/1990 | Cartellone | |
| 5,249,331 A | | 10/1993 | Mitani et al. | |
| 5,293,664 A | | 3/1994 | Lim et al. | |
| 6,032,327 A | * | 3/2000 | Oka et al. | 15/346 |
| 6,579,060 B1 | | 6/2003 | Mann, III et al. | |
| 6,591,441 B2 | | 7/2003 | Stegens et al. | |

* cited by examiner

*Primary Examiner*—David A Redding
(74) *Attorney, Agent, or Firm*—King & Schickli, PLLC

(57) ABSTRACT

A rug or carpet cleaner includes a housing, a suction generator carried on the housing and agitator carried on the housing. The agitator includes a hollow body, a cleaning projection carried on the hollow body, an air intake aperture provided in the cleaning projection and an outlet in fluid communication with the suction generator.

21 Claims, 5 Drawing Sheets

SUCTION GENERATOR
22
DIRT COLLECTOR
24
14
56
61'
61
61
4
30
20
48
56
56
50
51
D
60
Θ
60
58
32
53
42
46
38
54
34
60
58
C
C
36
54
52
44
18
A
B
A
40
4

METHOD AND APPARATUS FOR DEEP CLEANING RUG OR CARPET

This application claims the benefit of U.S. Provisional Patent Application Ser. No. 60/604,352 filed on 25 Aug. 2004.

TECHNICAL FIELD

The present invention relates generally to the floor care equipment field and, more particularly, to a method and apparatus for deep cleaning the nap of an underlying rug or carpet.

BACKGROUND OF THE INVENTION

A vacuum cleaner is an electrically powered, mechanical appliance utilized for the dry removal of dust and loose dirt from carpets, rugs, fabrics and other surfaces. Vacuum cleaners have been widely utilized for years in domestic and industrial cleaning applications.

In operation, a pressure drop is utilized to force air entrained with loose dirt and dust into the nozzle of the vacuum cleaner. The dust and dirt laden air is then drawn through a bag or dirt cup which traps and retains the dirt. The air is then exhausted by electric fan through an additional filter to remove relatively fine particles. It is this fan that provides the air pressure drop or vacuum that provides the cleaning action.

Airflow velocity and placement are the key parameters in determining the cleaning efficiency provided by the air drawn into the vacuum cleaner. A standard floor nozzle N for an upright or canister vacuum cleaner draws air under its entire perimeter and across its relatively large footprint area (see prior art design shown in FIG. 1). Airflow velocity V is minimal over most of this area, increasing gradually toward the mouth of the suction tube T, where it is maximized. Moreover, air, as a flow medium, follows the path of least resistance, and beyond the lower edge of the nozzle, will travel across the upper surface of the carpet. Hence, embedded residue is unaffected by airflow alone and deep carpet cleanability must rely almost exclusively on agitator performance. Stated another way, standard floor nozzles of the type illustrated in FIG. 1 fail to focus the airflow at the point where it is needed to provide deep cleaning action of the nap of a carpet or rug.

Long ago an attempt was made to focus airflow to provide better cleaning efficiency. Specifically, U.S. Pat. No. 1,601,774 to Scheffer describes a vacuum tool having a hollow cylinder formed with a plurality of suction apertures. The tool also includes a channel member formed with hollow trunnion ends which communicate with the legs of a tubular yoke via holes. Bearings mounted on each trunnion end secure within each end of the hollow roller. Thus, the roller may freely rotate about the channel member. In use, air is drawn through the apertures in the cylinder, the holes in the yoke and the handle.

Unfortunately, the vacuum cleaner tool disclosed in the Scheffer patent is only effective to focus the suction air stream along the upper ends of the nap and the surface of the rug or carpet. The Scheffer device fails to spread the nap of the rug or carpet to provide the desired deep cleaning at the base of the carpet and the bottom section of the nap. The present invention relates to an apparatus and method that provides true deep cleaning action. The apparatus and method of the present invention both spread the nap of the carpet in order to expose dirt and debris adjacent the base of the nap and simultaneously focus the suction airflow at the same location in order to provide greatly enhanced cleaning action heretofore unknown in the floor care cleaning industry.

SUMMARY OF THE INVENTION

In accordance with the purposes of the present invention as described herein, a rug or carpet cleaner is provided that is particularly adapted to provide high efficiency deep cleaning. The cleaner includes a housing, a suction generator carried on the housing and an agitator carried on the housing. The agitator includes a hollow body, a cleaning projection carried on the hollow body, an air intake aperture provided in the cleaning projection and an air discharge aperture in fluid communication with the suction generator. The rug or carpet cleaner may, for example, take the form of a canister vacuum cleaner, a handheld vacuum cleaner, an upright vacuum cleaner or an extractor.

In accordance with yet another aspect of the present invention an upright vacuum cleaner is provided. The upright vacuum cleaner includes a nozzle assembly having a nozzle inlet and a handle assembly pivotally connected to the nozzle assembly. A suction generator is carried on either the nozzle assembly or the handle assembly. A dirt collector is carried on the nozzle assembly or the handle assembly. The dirt collector may take the form of a traditional porous filter bag or a dirt cup or vessel.

An agitator is provided in the nozzle inlet. The agitator includes a hollow body, an air intake aperture in the hollow body and a discharge aperture in fluid communication with the dirt collector and the suction generator. The hollow body may be cylindrical in shape. Further, a cleaning projection may be provided on the hollow body. The air intake aperture is provided in the cleaning projection.

In one possible embodiment the cleaning projection is a rib. That rib may be in a chevron shape. The point of that chevron shaped rib may be provided adjacent a midline of the hollow body if desired. Further, multiple intake apertures may be provided in the rib. In another, alternative embodiment multiple cleaning projections are provided on the hollow body. At least one intake aperture is provided in at least some of the multiple cleaning projections.

In the various embodiments of the invention the hollow body defines an interior cavity. An intake manifold is received in the interior cavity. The intake manifold includes a suction inlet and at least one outlet. The suction inlet is provided adjacent a bottom dead center position of the hollow body. The suction inlet extends along an arc of between about 2 to about 90 degrees.

An optional seal may be provided. Such a seal extends around the suction inlet and engages the hollow body. A first outlet is provided in a first end of the intake manifold. A second outlet is provided in a second end of the intake manifold. The hollow body is carried on the manifold and rotates relative to the manifold.

More specifically, the manifold includes a first end and a second end. A first bushing is carried on the manifold adjacent the first end. A second bushing is carried on the manifold adjacent the second end. A first bearing is provided between the hollow body and the first bushing while a second bearing is provided between the hollow body and the second bushing. As a result, the hollow body freely rotates about the manifold on the first and second bearings.

In accordance with still another aspect of the present invention an agitator is provided for a cleaning apparatus. The agitator comprises a hollow body, a cleaning projection carried on the hollow body and an air intake aperture in the cleaning projection. In accordance with another aspect of this invention the hollow body defines an interior cavity and an intake manifold is received in that interior cavity.

In accordance with yet another aspect of the present invention a method is provided for deep cleaning a rug or carpet including nap held at one end in a base. The method comprises spreading the nap of the rug or carpet with a cleaning projection on a rotary agitator and drawing dirt and debris from between the spread nap and adjacent the base of the rug or carpet through an intake aperture in the cleaning projection.

In the following description there is shown and described several possible embodiments of the invention, simply by way of illustration of some of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain certain principles of the invention. In the drawings.

Reference will now be made in detail to the illustrated embodiments of the invention.

DETAILED DESCRIPTION OF THE INVENTION

Figure 1:
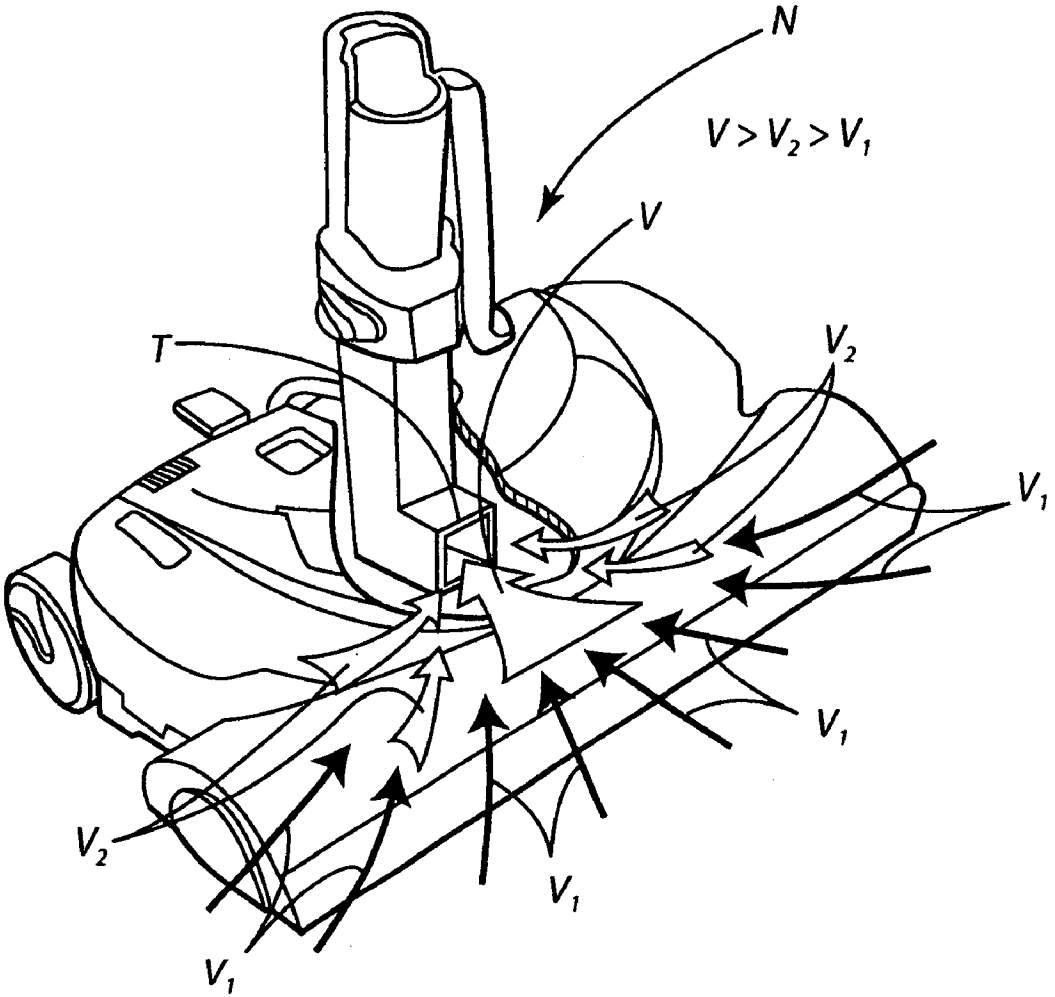
Fig. 1 PRIOR ART
FIG. 1 is a schematical view showing airflow produced by a standard floor nozzle of prior art design.
Figure 2:
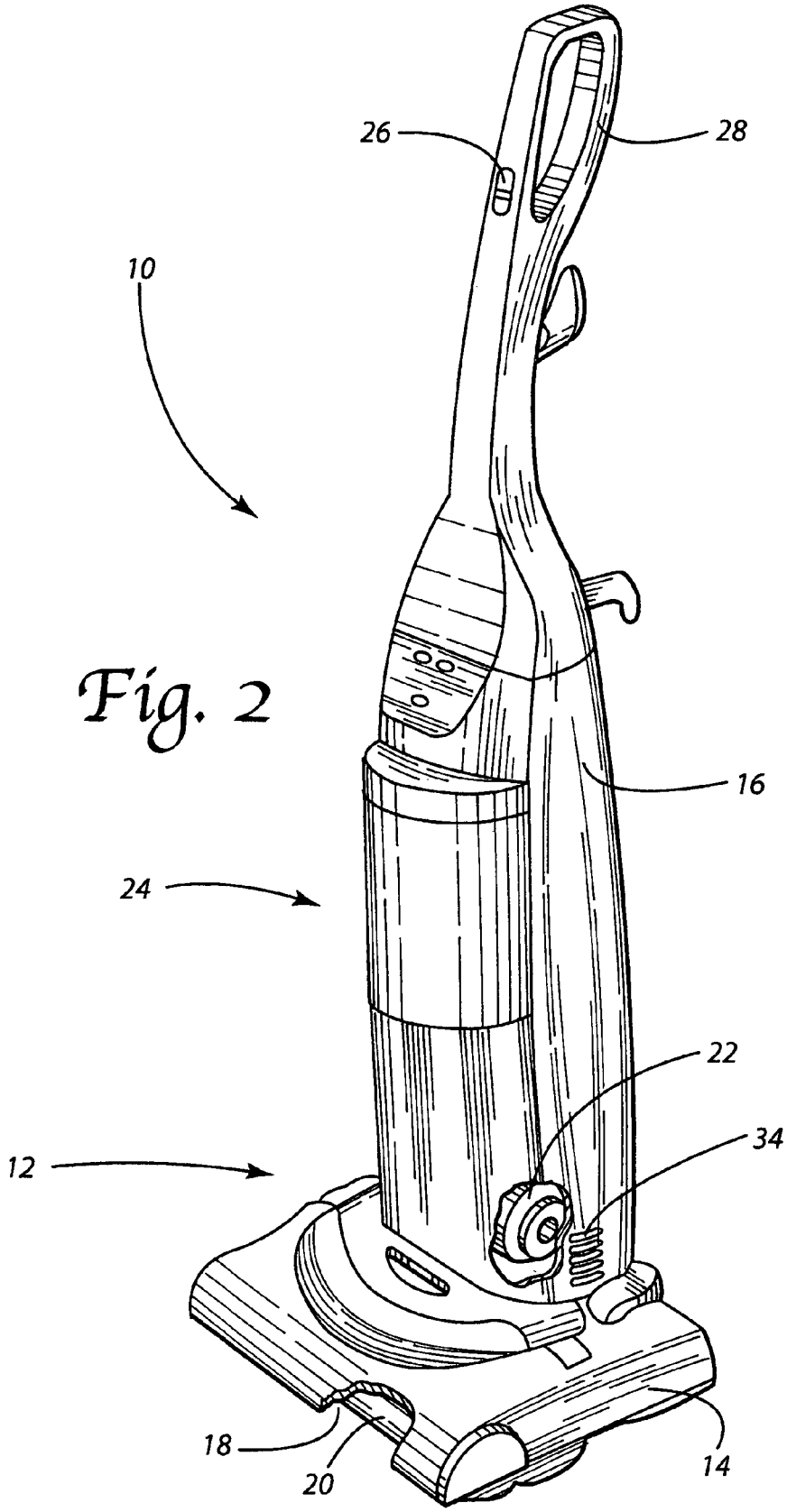
FIG. 2 is a perspective view of one possible embodiment, an upright vacuum cleaner, of the rug or carpet cleaner of the present invention.

Reference is now made to FIG. 2 illustrating an upright vacuum cleaner 10 constructed in accordance with the teachings of the present invention. This is just one possible embodiment of the rug or carpet cleaner of the present invention. Other possible embodiments include but are not limited to canister vacuum cleaners, handheld vacuum cleaners and extractors.

The vacuum cleaner 10 includes a housing, generally designated by reference numeral 12, including a nozzle assembly 14 and a handle assembly 16. As is known in the art, the handle assembly 16 is pivotally connected to the nozzle assembly 14 to aid the operator in manipulating the vacuum cleaner 10 back and forth across the floor. Wheels (not shown) carried on the housing 12 allow the vacuum cleaner 10 to be moved smoothly across the floor. As illustrated, the nozzle assembly 14 is equipped with a nozzle inlet 18. The nozzle inlet 18 also includes a rotary agitator 20.

The handle assembly 16 houses a suction generator 22 (i.e. a fan and motor assembly) and a dirt collector 24 having an internal dirt collection chamber. The handle assembly 16 also includes a control stalk 28 and an actuator switch 26 for turning the vacuum cleaner 10 on and off and thereby driving the rotary agitator 20 and the suction generator 22.

Figure 3:
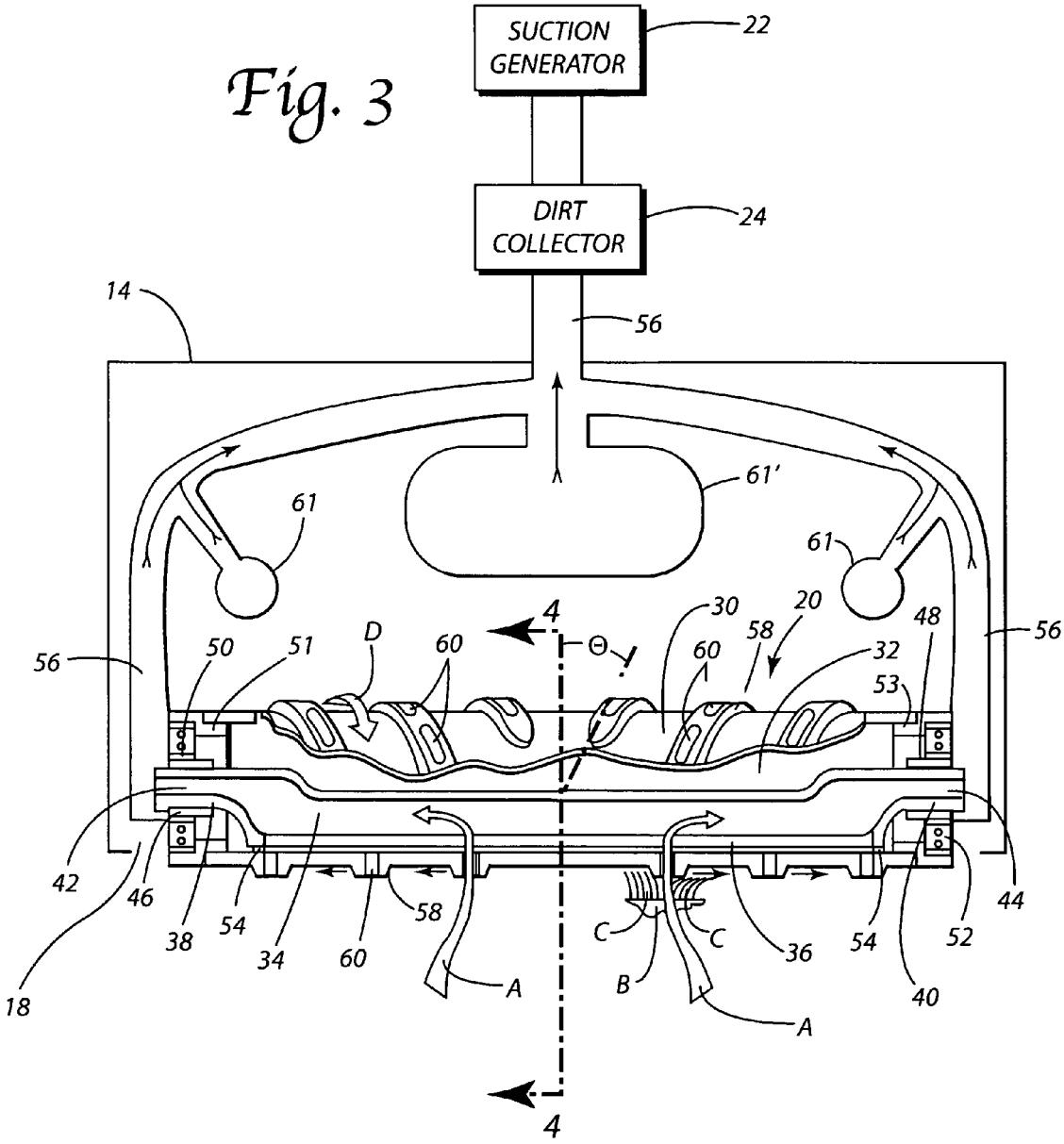
FIG. 3 is a schematical, detailed and partially cross sectional view showing the agitator of the present invention.
Figure 4:
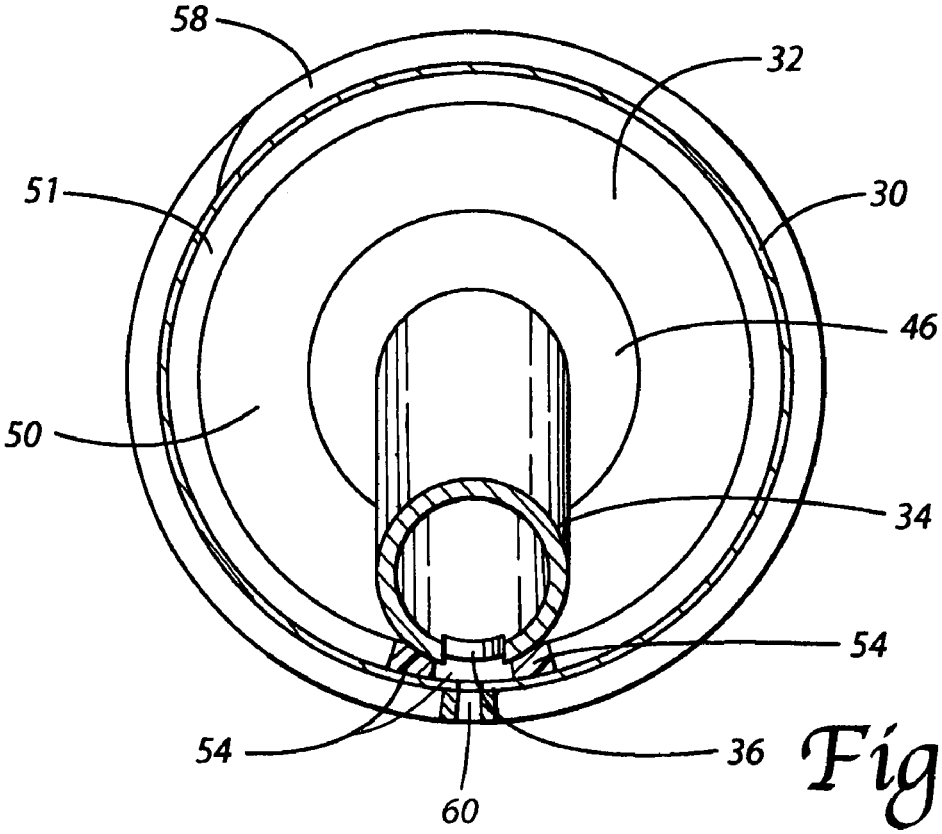
FIG. 4 is a cross sectional view of the agitator taken along line 4-4 of FIG. 3.

The agitator 20 is shown in detail in FIG. 3. The agitator 20 comprises a hollow cylindrical body 30 defining an interior cavity 32. An intake manifold or air tube 34 is received in the interior cavity 32. As illustrated in FIGS. 3 and 4 the intake manifold 34 includes a suction inlet 36 extending substantially the entire length of the hollow body 30. Additionally, the intake manifold 34 includes a first end 38 and a second end 40. A first outlet 42 is defined by the first end 38. A second outlet 44 is defined by the second end 40. The outlets 42, 44 are provided in fluid communication with the dirt collector 24 and the suction generator 22 by means of the conduits 56.

As further shown in FIG. 3, a first bushing 46 is provided at the first end 38 of the intake manifold 34 while a second bushing 48 is provided at the second end 40. A first bearing 50 is mounted in an end cap 51 provided in the first end of the hollow body 30. A second bearing 52 is mounted in an end cap 53 provided in the second end of the hollow body 30. As should be appreciated, the hollow body 30 rotates relative to the intake manifold 34 on the bearings 50, 52. The hollow body 30 may be driven by the motor of the suction generator 22 or a separate, dedicated drive motor. The power is transmitted from the motor to the hollow body 30 of the agitator 20 by means of a belt and pulley arrangement or gear drive arrangement (not shown) either near the center or adjacent one or both ends thereof.

As best illustrated in FIG. 4, it should be appreciated that the suction inlet 36 is provided adjacent the bottom dead center position of the hollow body 30 as near as possible to the underlying carpet or rug being cleaned. This suction inlet extends along an arc of between about 2 to about 90 degrees with respect to the circular cross-section of the intake manifold 34. That arc may or may not be evenly divided by the centerline passing through the bottom dead center position of the hollow body 30. An optional seal 54 extends around the suction inlet 36 and engages the inner wall of the hollow body 30.

During operation the agitator 20 is rotated. During this rotation, cleaning projections 58 carried on the outer wall of the hollow body 30 spread the nap C of the underlying carpet being cleaned. This exposes the base B of the nap and carpet including any dirt and debris present. As further illustrated in FIGS. 3 and 4, an air intake aperture 60 is provided in the cleaning projection 58. As the hollow body 30 of the agitator 20 is rotated, the air intake aperture 60 is moved into communication with the suction inlet 36 of the intake manifold 34. As a result, air is drawn rapidly into the air intake aperture 60 just as the cleaning projection 58 is spreading the nap of the carpet and exposing dirt and debris at the base thereof (see action arrow A in FIG. 3). That dirt and debris is drawn by the airstream from the base of the carpet through the air intake aperture 60 in the cleaning projection 58 and the suction inlet 36 into the intake manifold 34. From there the air entrained with dirt and debris is drawn through the conduits 56 into the dirt collector 24. There the dirt and debris is entrapped. The air is then forced over the motor of the suction generator 22 to provide cooling before being exhausted into the environment through a final filter (not shown).

The cleaning projection 58 may take a number of forms. As illustrated in FIG. 3, the cleaning projection 58 may assume the form of a rib. In one possible embodiment the cleaning projection rib 58 assumes a chevron, helical or screw-thread shape. As illustrated in FIG. 3, the point of the chevron may be provided adjacent a centerline or midline of the hollow body 30, whereby a second chevron may exist on the opposite side of the midline as a mirror image. As a result, equal and opposite contact forces are generated by each rib 58. These forces cancel each other and prevent the vacuum cleaner 10 from pulling to either side. Further, equal and opposite air velocity gradients are provided on each side of the centerline so as to provide more uniform pickup across the entire length of the agitator 20. The point may be directed forward during the rotation (note direction of rotation arrow D) so that the leading face of the rib pushes the nap of the carpet and dirt and debris outward toward the corresponding sides of the vacuum cleaner 10 and optional inlets 61, if provided.

Of course, any plurality and configuration of projection ribs 58 may be provided along the outer surface of the hollow body 30 of the agitator 20. Further, multiple air intake apertures 60 are provided along the length of each rib. The air intake apertures 60 may be spaced so that a substantially constant intake aperture surface area is in communication with the suction inlet 36 of the intake manifold 34 during the rotation of the hollow body 30 at all times. As a result a relatively constant load is maintained on the suction generator 22 and a relatively constant suction level is maintained.

Of course, the size, shape and number of all intake apertures 60 may be varied in order to adjust vacuum cleaner performance and/or to accommodate larger debris. Further, it should be appreciated that the nozzle assembly 14 of the vacuum cleaner 10 may also be equipped with optional suction inlets 61, 61'. More specifically, as illustrated in FIG. 3, a single suction inlet 61 may be provided adjacent each end of the agitator 20 so that dirt and debris is brushed by the ribs 58 toward those inlets. Alternatively, a single suction inlet 61' may be provided along the centerline of the agitator 20, aligned with. the gap or apex between the two ribs 58. In this configuration, the approach angle,θ, of the ribs or chevrons 58 is reversed so that dirt and debris is brushed by the ribs toward this centrally located suction inlet 61'.

Figure 5B:
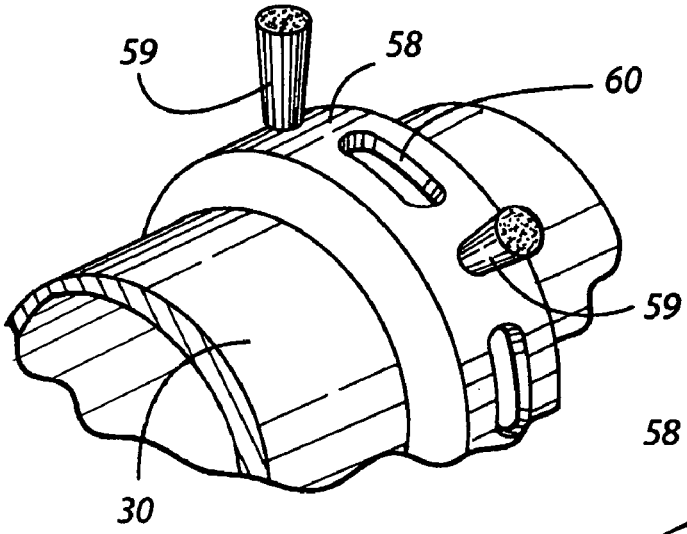
FIGS. 5*a* and 5*b* are detailed, cutaway perspective views illustrating two possible alternative embodiments including tufts of bristles on the cleaning projection rib.
Figure 5A:
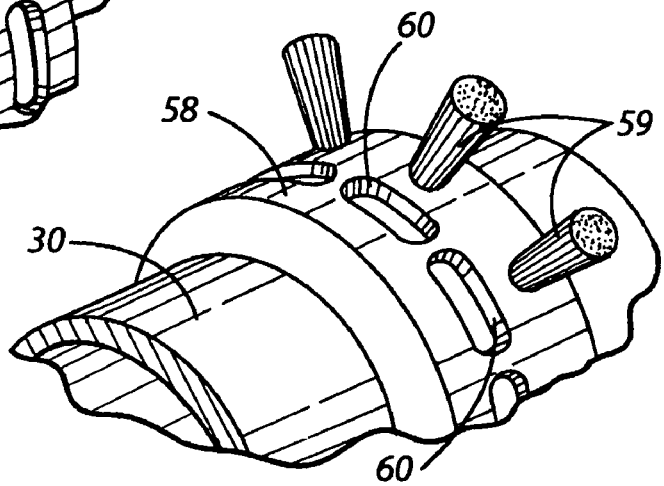

As illustrated in FIGS. 5*a* and 5*b*, each rib 58 may include multiple cleaning tufts 59 of bristles. As illustrated in FIG. 5*a*, the tufts 59 may be provided in line with the intake apertures 60 in an alternating pattern. Of course, a different pattern could be utilized. As illustrated in FIG. 5*b*, the tufts 59 may be provided on the rib 58 beside the intake apertures 60 in a side-by-side arrangement.

Figure 6:
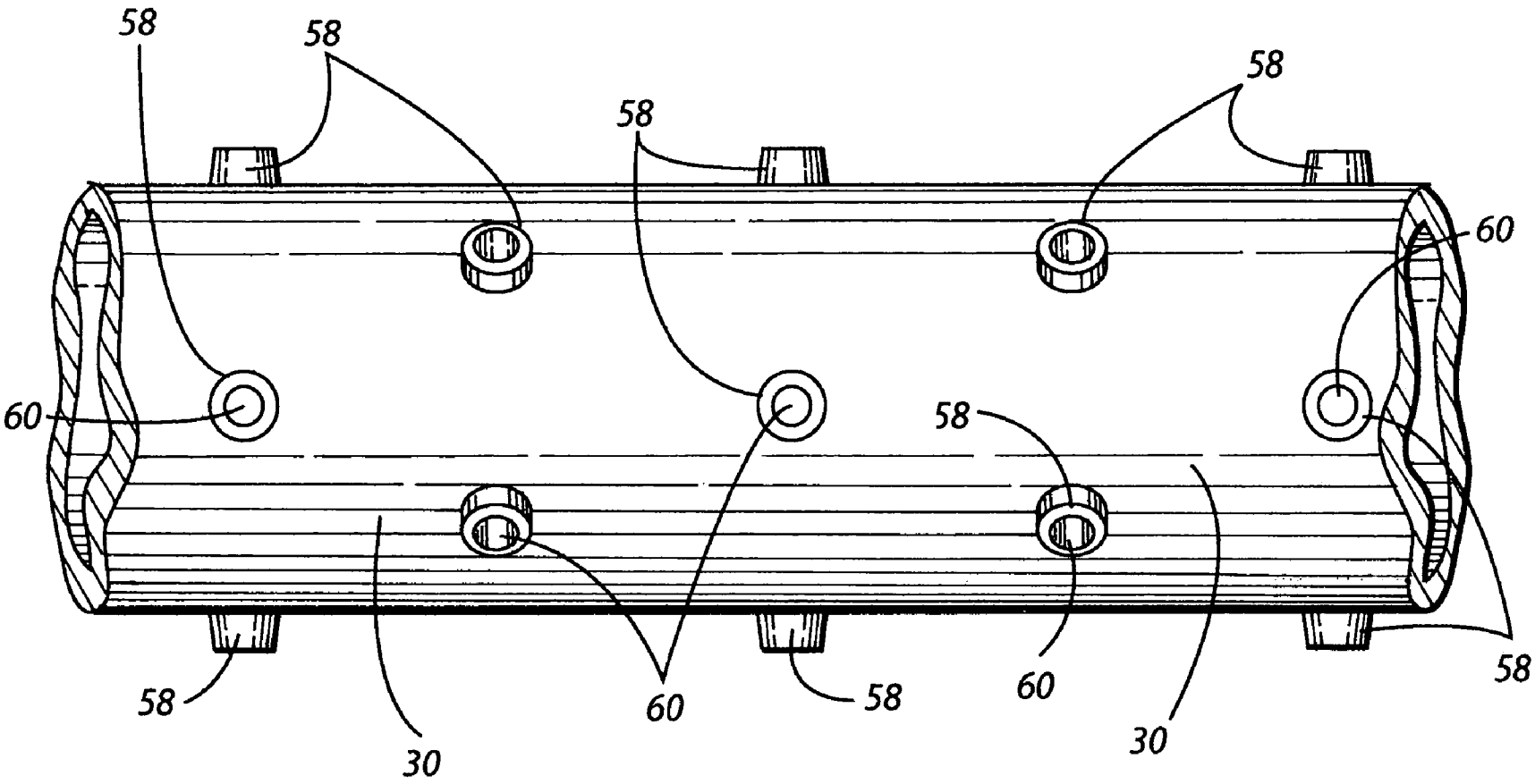
FIG. 6 is a side elevational view of still another alternative embodiment of the agitator of the present invention.

In accordance with an alternative agitator embodiment illustrated in FIG. 6, multiple cleaning projections 58 are provided across the surface of the hollow body 30. The multiple cleaning projections 58 may be randomly provided or placed in a distinct pattern. At least one air intake aperture 60 is provided in some or all of the cleaning projections 58. Accordingly, as each cleaning projection 58 spreads the nap of the underlying carpet, the air intake aperture 60 associated therewith is simultaneously brought into communication with the suction inlet 36 of the intake manifold 34 so that dirt and debris is drawn from the base B of the carpet from between the spread nap C. As a consequence deep cleaning action is assured. Advantageously, the present invention is the first rug or carpet cleaner that effectively brings mechanical and pneumatic cleaning action. together at a single point (i.e. the base of the spread nap) to simultaneously provide the most efficient cleaning possible.

The foregoing description of a preferred embodiment of the invention has been presented for purposes of illustration and description. It is not intended to be exhaustive or to limit the invention to the precise form disclosed. Obvious modifications or variations are possible in light of the above teachings.

For example, while bushings 46, 48 are illustrated and described, it should be appreciated that the bushings may be eliminated and the manifold ends 38, 40 may extend through and directly contact the inner races of the bearings 50, 52. While the illustrated embodiment is an upright vacuum cleaner, the present invention also relates to and includes canister and handheld vacuum cleaners as well as extractors. Further, while the illustrated embodiment is a "clean air" system with a suction generator 22 downstream from the dirt collector 24, the present invention also includes "dirty air" systems where the suction generator is located upstream of the dirt collector. Further, while the illustrated vacuum cleaner 10 includes one rotary agitator, it could include two or more rotary agitators.

It should also be appreciated that the lead or approach angle Θ (see FIG. 3) of the ribs 58 may be varied. The smaller the angle Θ, the more gradually the nap is separated. Thus, the agitator 20 is more gentle on the carpet and produces less noise during operation. Finally, it should be appreciated that the dirt collector 24 may take the form of a standard vacuum cleaner bag made from a filter media or a dirt cup. Such a dirt cup may assume substantially any shape. In one possible embodiment, the dirt cup includes a cylindrically shaped collection chamber. When equipped with a tangentially directed inlet, such a dirt cup produces a cyclonic flow of air for enhanced cleaning. A primary filter may be located in the dirt cup or downstream from the dirt cup but upstream from the suction generator.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

The invention claimed is:

1. A rug or carpet cleaner, comprising:

a housing:

a suction generator carried on said housing;

an agitator carried on said housing, said agitator including a hollow body, a cleaning projection carried on said hollow body, an air intake aperture provided in said cleaning projection and an outlet in fluid communication with said suction generator; and a motor carried on said housing, said motor rotatably driving said hollow body.

2. An upright vacuum cleaner, comprising:

a nozzle assembly including a nozzle inlet;

a handle assembly pivotally connected to said nozzle assembly;

a suction generator carried on one of said nozzle assembly and said handle assembly;

a dirt collector carried on one of said nozzle assembly and said handle assembly;

an agitator provided in said nozzle inlet, said agitator including a hollow body, an air intake aperture in said hollow body and at least one outlet in fluid communication with said dirt collector and said suction generator whereby the agitator is positioned such that dirt and debris are drawn through said hollow body toward and into said dirt collector.

3. The vacuum cleaner of claim 2, wherein said hollow body is cylindrical in shape.

4. The vacuum cleaner of claim 2, further including a cleaning projection on said hollow body.

5. The vacuum cleaner of claim 4, wherein said intake aperture is provided in said cleaning projection.

6. The vacuum cleaner of claim 5, wherein said cleaning projection is a rib.

7. The vacuum cleaner of claim 6, wherein said rib is in a chevron, helix or screw-thread shape.

8. The vacuum cleaner of claim 7, wherein a point of said chevron shaped rib is provided adjacent a midline of said hollow body.

9. The vacuum cleaner of claim 6, wherein multiple intake apertures are provided in said rib.

10. The vacuum cleaner of claim 2, further including multiple cleaning projections on said hollow body.

11. The vacuum cleaner of claim 10, wherein at least one intake aperture is provided in at least some of said multiple cleaning projections.

12. The vacuum cleaner of claim 2, wherein said hollow body defines an interior cavity and an intake manifold is received in said interior cavity.

13. The vacuum cleaner of claim 12 wherein said intake manifold includes a suction inlet and said at least one outlet.

14. The vacuum cleaner of claim 13, wherein said suction inlet is provided adjacent a bottom dead center position of said hollow body.

15. The vacuum cleaner of claim 14, wherein said suction inlet extends along an arc of between about 2 to about 90 degrees.

16. The vacuum cleaner of claim 14, further including a seal extending around said suction inlet and engaging said hollow body.

17. The vacuum cleaner of claim 13, wherein a first outlet is provided in a first end of said intake manifold.

18. The vacuum cleaner of claim 17, wherein a second outlet is provided in a second end of said intake manifold.

19. The vacuum cleaner of claim 12, said hollow body is carried on said manifold and rotates relative to said manifold.

20. The vacuum cleaner of claim 12, wherein said manifold includes a first end and a second end, a first bushing carried on said manifold adjacent said first end, a second bushing carried on said manifold adjacent a second end, a first bearing provided between said hollow body and said first bushing and a second bearing provided between said hollow body and said second bushing.

21. The vacuum cleaner of claim 12, wherein said manifold includes a first end and a second end, a first bearing provided between said hollow body and said first end and a second bearing provided between said hollow body and said second end.

* * * * *